US006377517B1

(12) United States Patent
Tursich

(10) Patent No.: US 6,377,517 B1
(45) Date of Patent: Apr. 23, 2002

(54) METHOD AND SYSTEM FOR SYNCHRONIZING A TIME OF DAY CLOCK BASED ON A SATELLITE SIGNAL AND A COMMUNICATION SIGNAL

(75) Inventor: Stephen B. Tursich, Peyton, CO (US)

(73) Assignee: Agilent Technologies Inc., Palo Alto, CA (US)

( * ) Notice: Subject to any disclaimer, the term of this patent is extended or adjusted under 35 U.S.C. 154(b) by 0 days.

(21) Appl. No.: 09/690,532

(22) Filed: Oct. 17, 2000

(51) Int. Cl.[7] ..... G04C 11/02
(52) U.S. Cl. ..... 368/47
(58) Field of Search ..... 368/46, 47, 52; 455/500, 502, 550, 556

(56) References Cited

U.S. PATENT DOCUMENTS 5,319,374 A * 6/1994 Desai et al. ..... 342/387
5,805,530 A * 9/1998 Youngberg ..... 368/10
6,236,623 B1 * 5/2001 Read et al. ..... 368/46
6,282,431 B1 * 8/2001 Konno ..... 455/550
6,288,977 B1 * 9/2001 Yoshida et al. ..... 368/47

* cited by examiner

*Primary Examiner*—Vit Miska

(57) ABSTRACT

A method for synchronizing a time of day clock of a clock system is disclosed. A portable satellite timing system receives a satellite signal when at a first location and generates a time of day signal. The portable satellite timing system is then transported to a second location, where the satellite signal cannot be reliably received, and coupled to the clock system. The portable satellite timing system transfers the time of day signal to the clock system. Concurrently, the clock system receives a communication signal from a communication system and recovers a clock signal from a communication signal. The clock system synchronizes the time of day clock based on the time of day signal and the clock signal. The disclosed method advantageously synchronizes the time of day clock located in a structure without having to install a satellite antenna on the outside of the structure.

12 Claims, 8 Drawing Sheets

LOCATION 361
LOCATION 362
310
PORTABLE SATELLITE TIMING SYSTEM
304
TIME OF DAY CLOCK
334
316
CLOCK RECOVERY SYSTEM
332
CLOCK SYSTEM
302
318
COMMUNICATION SYSTEM
306

METHOD AND SYSTEM FOR SYNCHRONIZING A TIME OF DAY CLOCK BASED ON A SATELLITE SIGNAL AND A COMMUNICATION SIGNAL

BACKGROUND OF THE INVENTION

1. Field of the Invention

The invention relates to the field of clock systems, and in particular, to synchronizing a time of day clock.

2. Statement of the Problem

In some situations, it may be advantageous to have a clock system that is synchronized with a time standard such as Universal Time Coordinated (UTC). It may also be advantageous for two or more systems to have clock systems that are substantially synchronized. For instance, a clock system for a test apparatus may be synchronized with a clock system of a system under test. One method of synchronizing clock systems is by connecting to a Network Time Protocol (NTP) server. The Network Time Protocol (NTP) is used to synchronize the time of a computer client or server to another server or reference time source. NTP provides client accuracies typically within a millisecond on Local Area Networks (LANs) and up to a few tens of milliseconds on Wide Area Networks (WANs) relative to a primary server synchronized to the UTC. A problem with synchronizing a system with the NTP server is the system needs a connection to the NTP server such as a radio receiver, a satellite receiver, or a modem. The NTP server connection may be expensive and/or impractical to use.

Another method of synchronizing clock systems to a time standard is with a Global Positioning System (GPS). A GPS receiver receives a GPS satellite signal from satellites through a GPS antenna. The GPS satellite signal carries a highly accurate time of day signal on a stabilized frequency. The GPS satellite signal also carries a 1 Hz signal and a 10 MHz signal. The time of day signal, the 1 Hz signal, and the 10 MHz signal are synchronized to the UTC. When the GPS receiver is coupled to a clock system, the clock system synchronizes an internal time of day clock based on the time of day signal, the 1 Hz clock signal, and the 10 MHz clock signal. The 10 MHz signal is the reference frequency from which the time of day clock keeps time. The time of day clock is synchronized to the UTC as long as the GPS receiver provides the 10 MHz signal.

A problem arises when a clock system is in a location where the GPS satellite signal cannot be received on a reliable basis. For instance, the clock system is typically in a structure. In such a case, the GPS antenna is mounted on the outside of the structure where the GPS satellite signal can be received. The mounted GPS antenna requires a cable be run through the structure to the GPS receiver. A problem is that situations may arise where it is not possible or desirable to mount a GPS antenna on the structure, or desirable to run the cable through the structure.

SUMMARY OF THE SOLUTION

A method for synchronizing a time of day clock of a clock system solves the above problems. Advantageously, the method synchronizes the time of day clock that is located where a reliable satellite signal cannot be received. The time of day clock, when in a structure for instance, can be synchronized to the UTC without having to install an antenna on the outside of the structure or run a cable through the structure.

For this method, a portable satellite timing system is initially positioned at a first location where the portable satellite timing system receives a satellite signal. The satellite signal includes a first time of day signal. The portable satellite timing system calibrates its internal clock based on the first time of day signal. From the internal clock, portable satellite timing system generates a second time of day signal. The portable satellite timing system is then transported to a second location and coupled to the clock system. The satellite signal is not available on a reliable basis at the second location, so the portable satellite timing system maintains the second time of day signal while at the second location. The portable satellite timing system transfers the second time of day signal to the clock system. Concurrently, the clock system receives a communication signal from a communication system. The clock system recovers a clock signal from the communication signal and transfers the clock signal to the clock system. The clock system synchronizes its time of day clock based on the second time of day signal and the clock signal.

DETAILED DESCRIPTION OF THE INVENTION

Figure 1:
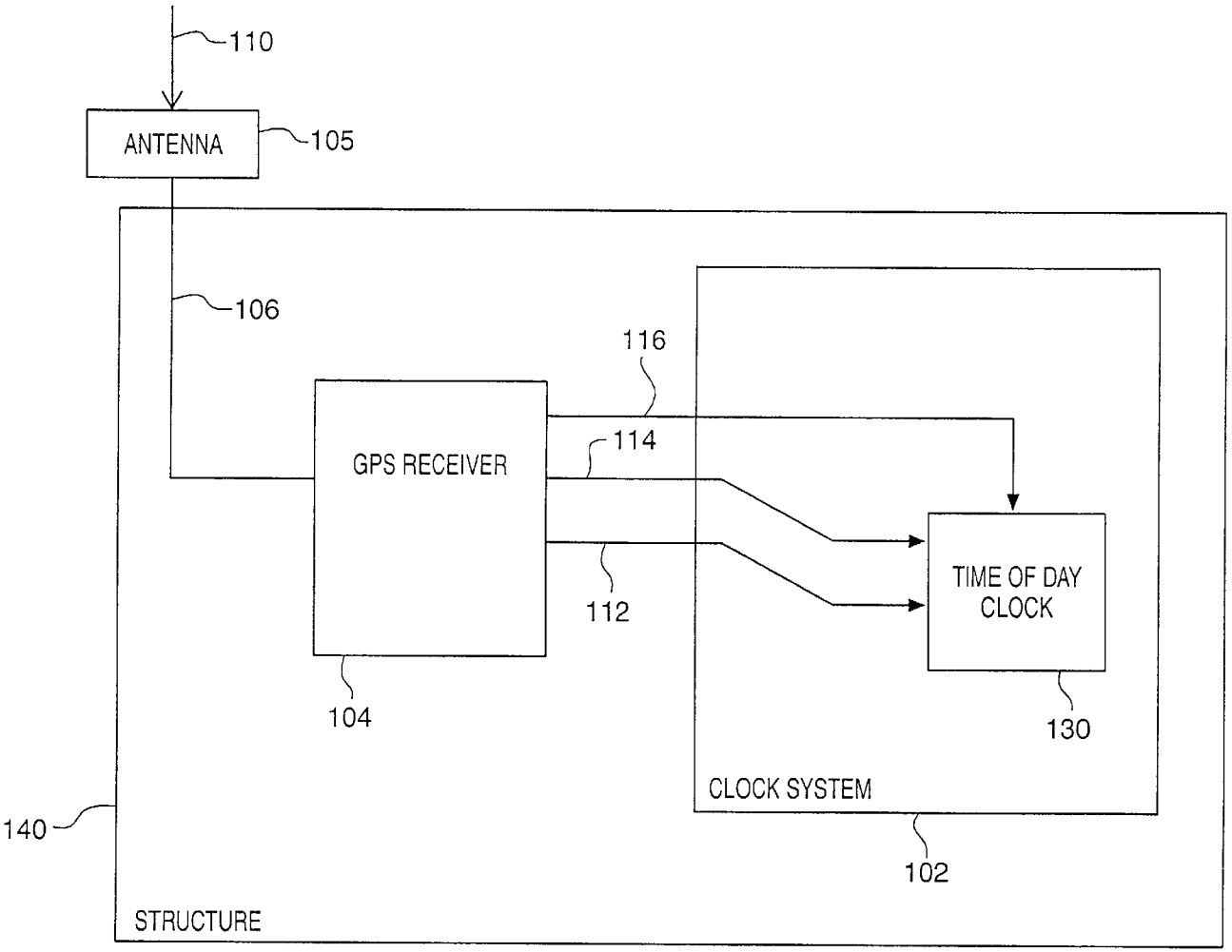
FIG. 1 PRIOR ART
FIG. 1 is a block diagram that depicts a system for synchronizing a time of day clock of a clock system in the prior art.
Figure 2:
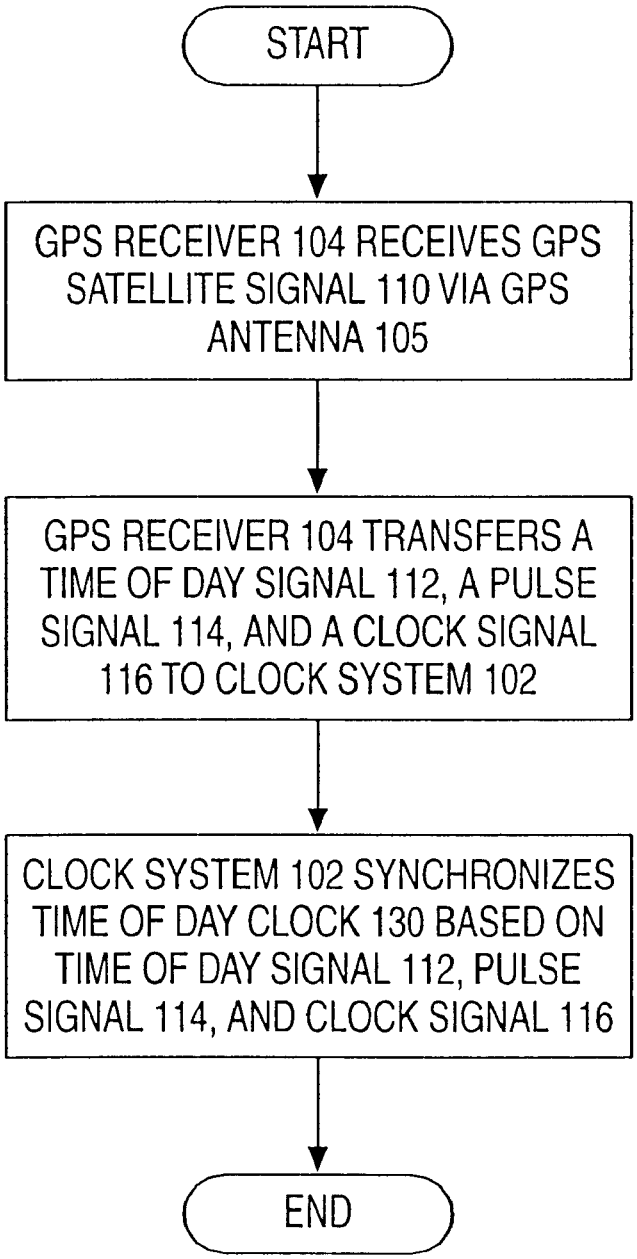
FIG. 2 PRIOR ART
FIG. 2 is a flow chart that depicts a method for synchronizing a time of day clock in the prior art.

Prior Art Method for Synchronizing a Clock System—FIGS. 1–2

In order to more clearly understand the invention, FIGS. 1–2 show a system and method of synchronizing a time of day clock 130 of a clock system 102 in the prior art. FIG. 1 depicts a GPS receiver 104 coupled to clock system 102 and a GPS antenna 105. Clock system 102 is comprised of time of day clock 130. GPS receiver 104 and clock system 102 are located inside a structure 140 where a GPS satellite signal 110 cannot be received on a reliable basis. GPS antenna 105 is mounted on the outside of structure 140 and is configured to receive GPS satellite signal 110. GPS satellite signal 1 10 includes a time of day signal 112, a pulse signal 114, and a clock signal 116. Time of day signal 112 represents the current time of day, pulse signal 114 is a 1 Hz signal, and clock signal 116 is a 10 MHz signal. GPS antenna 105 is coupled to GPS receiver 104 by a cable 106 that runs through structure 140.

FIG. 2 depicts the method of synchronizing time of day clock 130. GPS receiver 104 receives GPS satellite signal 110 via GPS antenna 105. GPS receiver 104 transfers time of day signal 112, pulse signal 114, and clock signal 116 to clock system 102. Clock system 102 synchronizes time of day clock 130 based on time of day signal 112, pulse signal 114, and clock signal 116.

To synchronize time of day clock 130, clock system 102 initializes time of day clock 130 based on time of day signal 112 at a rising edge of pulse signal 114. After initializing time of day clock 130, clock system 102 increments time of day clock 130 based on clock signal 116 to keep track of time. Time of day clock 130 is now synchronized to the UTC because time of day signal 112, pulse signal 114, and clock signal 116 are synchronized to the UTC.

Figure 3:
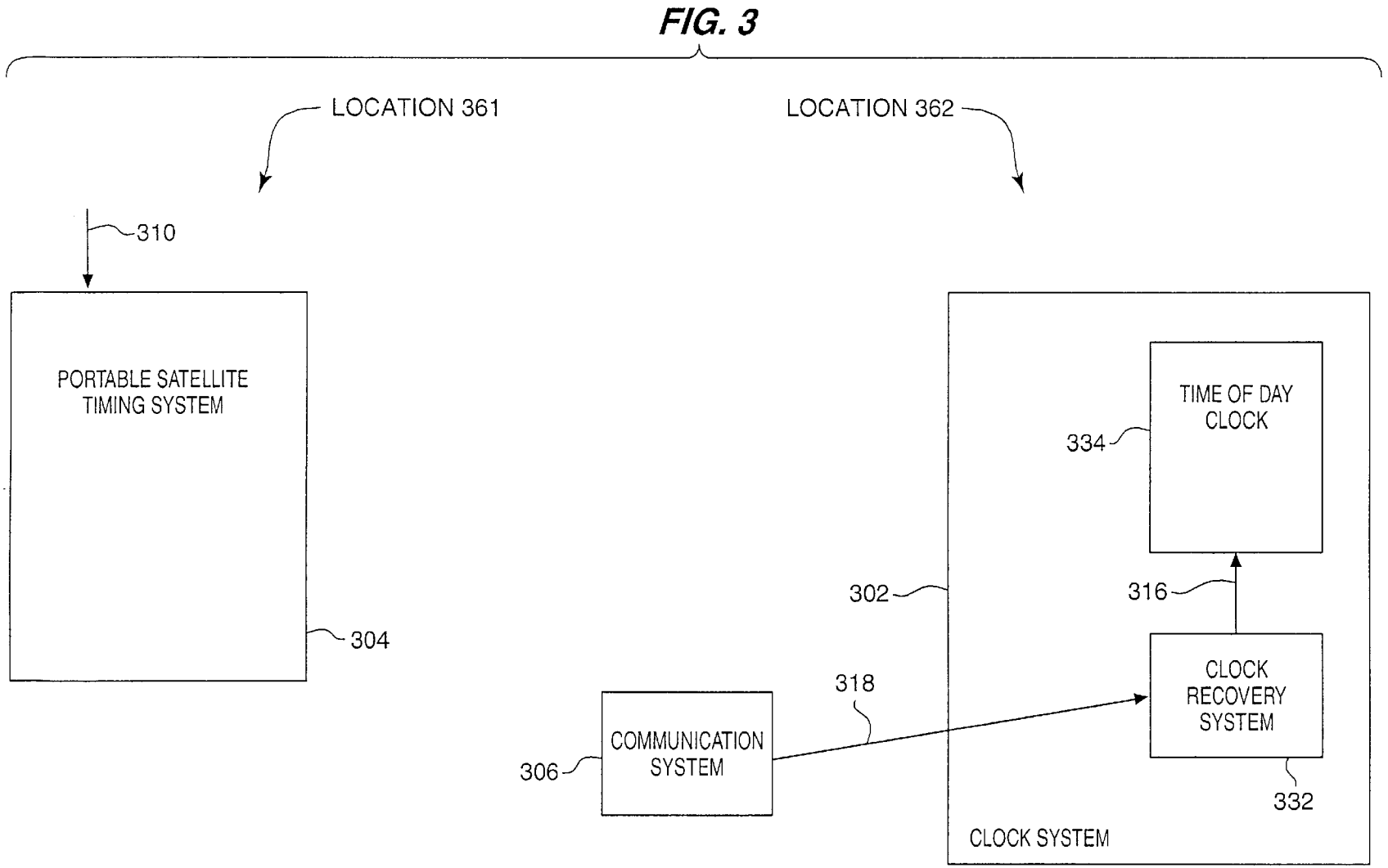
FIG. 3 is a block diagram that depicts a portable satellite timing system in a first location and de-coupled from a clock system in an example of the invention.
Figure 4:
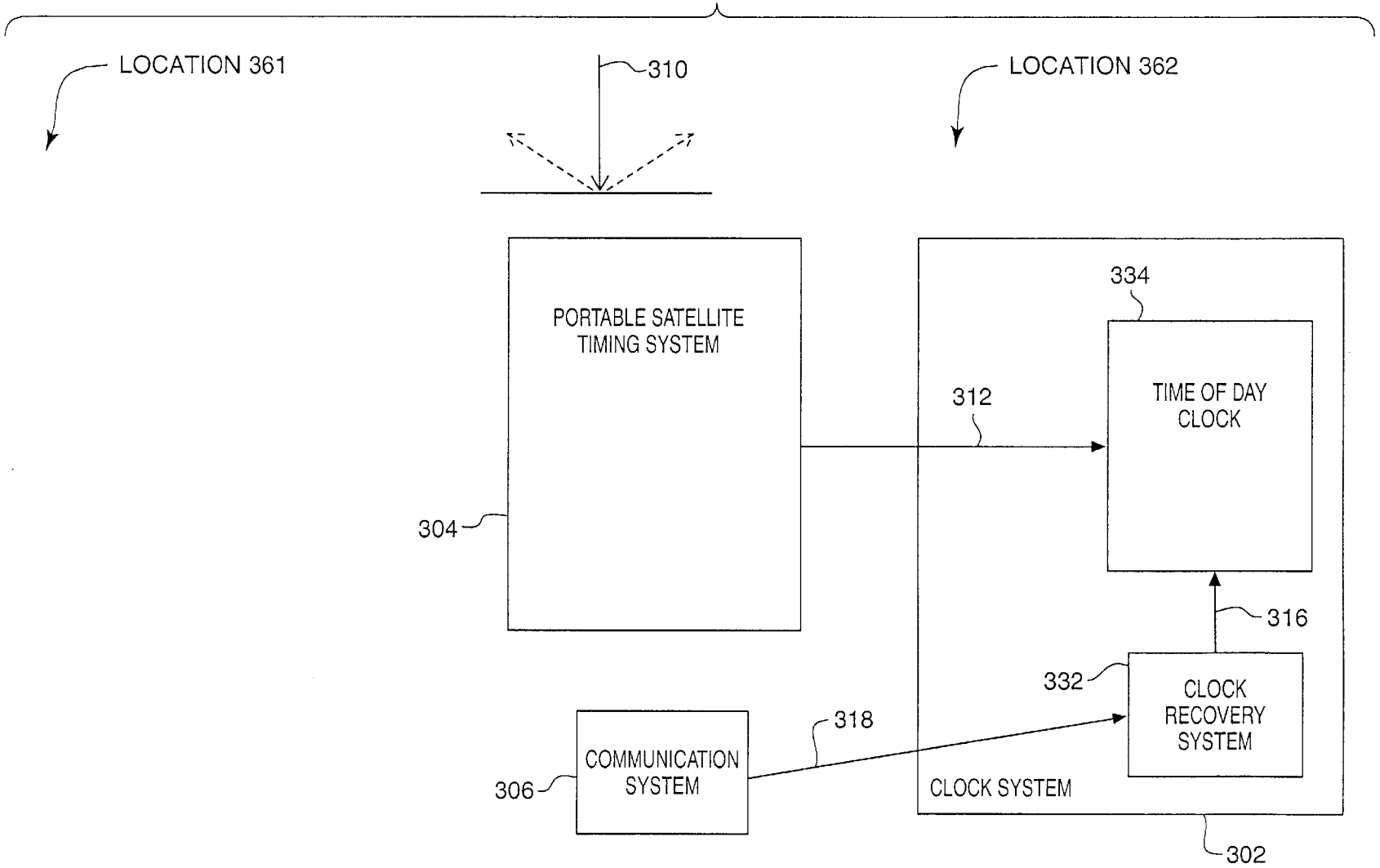
FIG. 4 is a block diagram that depicts a portable satellite timing system in a second location and coupled to a clock system in an example of the invention.
Figure 5:
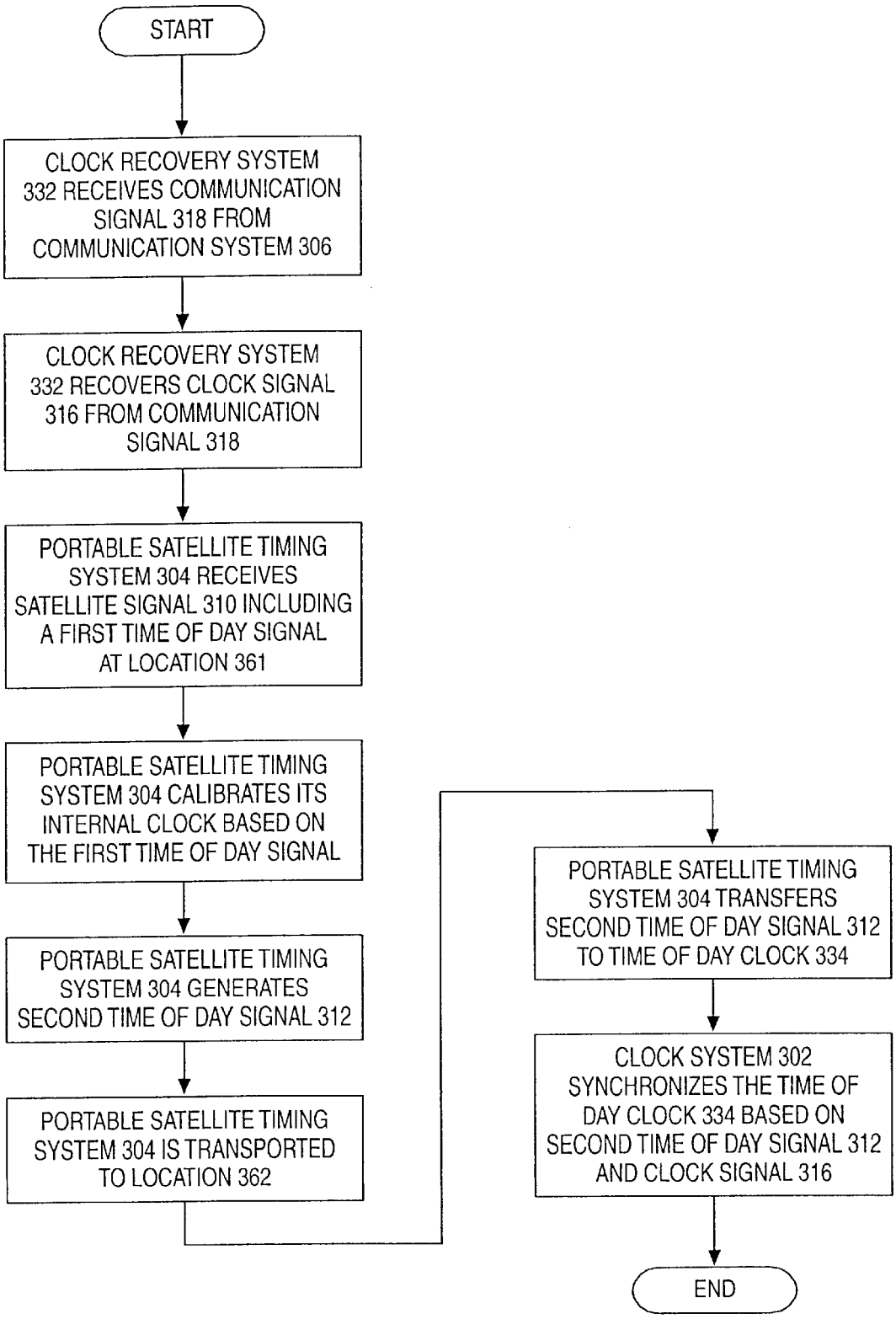
FIG. 5 is a flow chart that depicts a method of synchronizing a time of day clock of a clock system in an example of the invention.

First Method and System for Synchronizing a Time of Day Clock—FIGS. 3–5

FIGS. 3–5 depict a specific example of a method and system for synchronizing time of day clock 334 of a clock system 302 in accord with the present invention. Those skilled in the art will appreciate numerous variations from this example that do not depart from the scope of the invention. Those skilled in the art will also appreciate that various features described below could be combined with other embodiments to form multiple variations of the invention. Those skilled in the art will appreciate that some conventional aspects of FIGS. 3–5 have been simplified or omitted for clarity.

FIG. 3 depicts clock system 302 positioned at location 362 where satellite signal 310 cannot be received on a reliable basis. Portable satellite timing system 304 is positioned at location 361 and de-coupled from clock system 302. Portable satellite timing system 304 is configured to receive satellite signal 310. Satellite signal 310 includes a first time of day signal. Communication system 306 is coupled to clock system 302 and is configured to transfer communication signal 318 to clock system 302. Communication system 306 could be at location 361, location 362, or some other location. Clock system 302 is comprised of a clock recovery system 332 and time of day clock 334. Clock recovery system 332 is coupled to time of day clock 334. Clock recovery system 332 is configured to recover clock signal 316 from communication signal 318.

FIG. 4 depicts portable satellite timing system 304 re-positioned at location 362 and coupled to clock system 302. Portable satellite timing system 304 does not receive satellite signal 310 at location 362 on a reliable basis. Portable satellite timing system 304 is configured to generate second time of day signal 312 based on the first time of day signal and transfer second time of day signal 312 to clock system 302.

FIG. 5 depicts a method of synchronizing time of day clock 334. Clock recovery system 332 receives communication signal 318 from communication system 306. Clock recovery system 332 recovers clock signal 316 from communication signal 318 and transfers clock signal 316 to time of day clock 334. Portable satellite timing system 304 receives satellite signal 310 at location 361 as shown in FIG. 3. Portable satellite timing system 304 calibrates its internal clock based on the first time of day signal. Portable satellite timing system 304 generates second time of day signal 312 based on its internal clock. Portable satellite timing system 304 is then transported to location 362 and coupled to clock system 302 as shown in FIG. 4. Portable satellite timing system 304 transfers second time of day signal 312 to time of day clock 334. Clock system 302 synchronizes time of day clock 334 based on second time of day signal 312 and clock signal 316. Portable satellite timing system 304 may then be disconnected.

Figure 6:
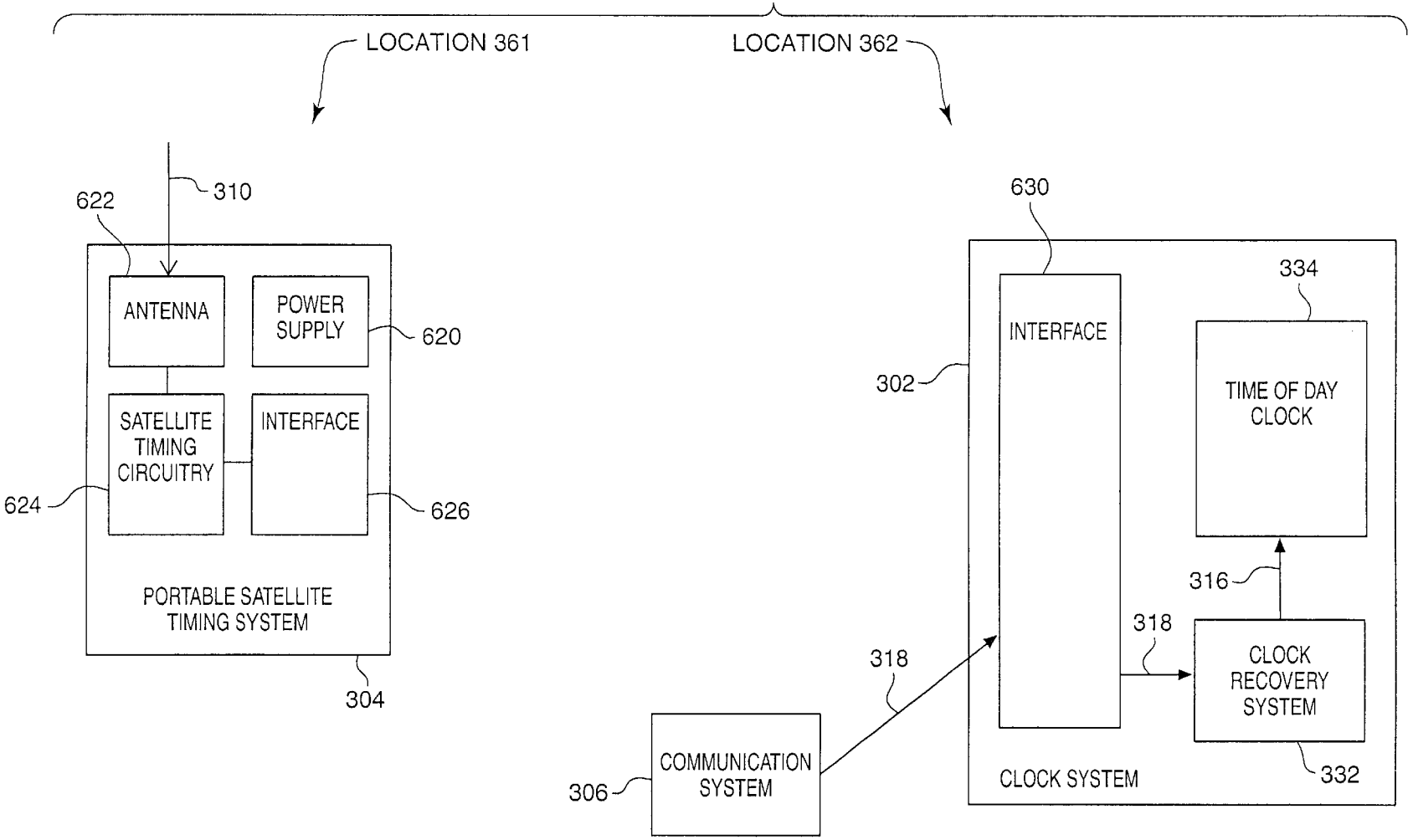
FIG. 6 is a block diagram that depicts a portable satellite timing system in a first location and de-coupled from a clock system in an example of the invention.
Figure 7:
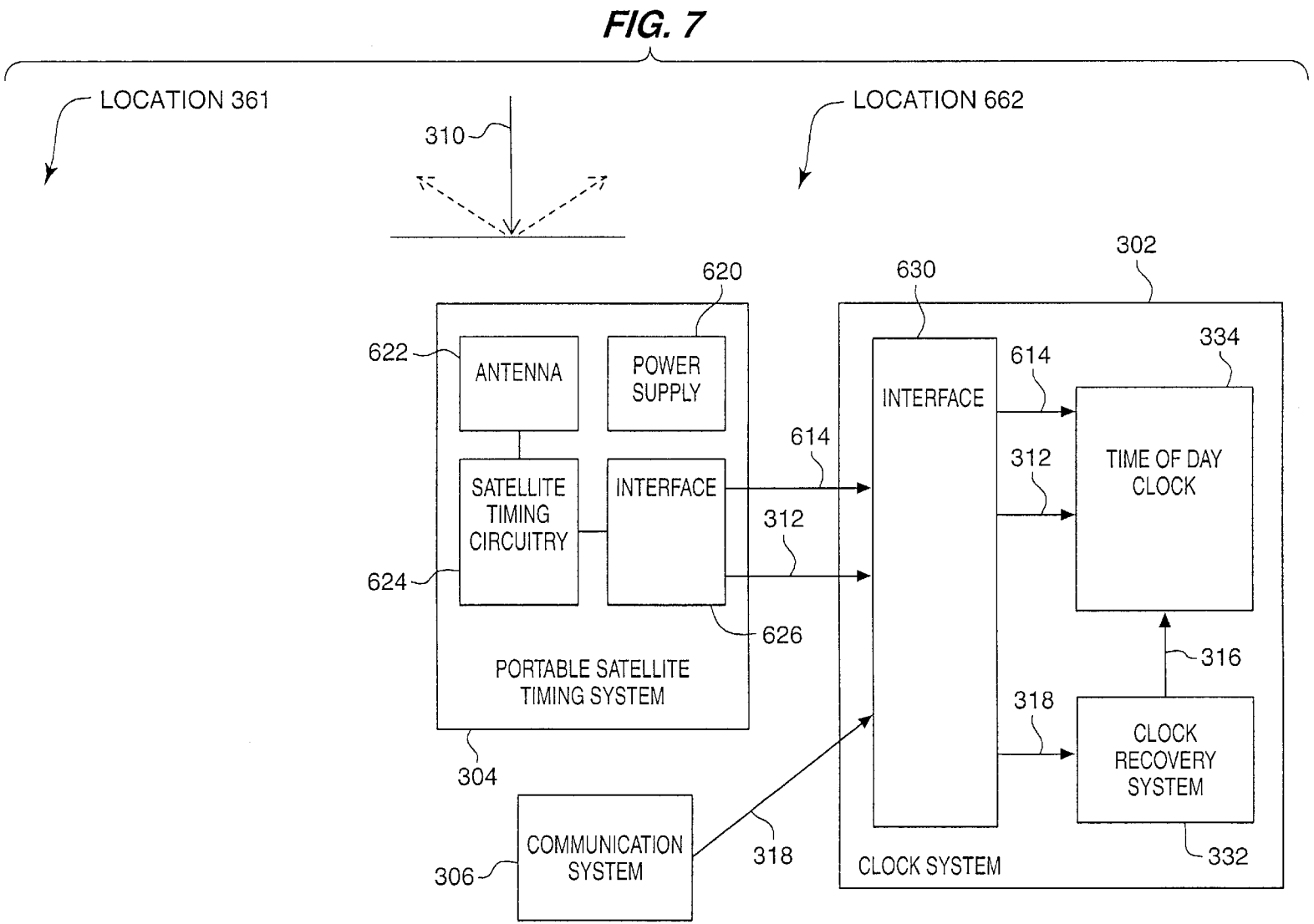
FIG. 7 is a block diagram that depicts a portable satellite timing system in a second location and coupled to a clock system in an example of the invention.
Figure 8:
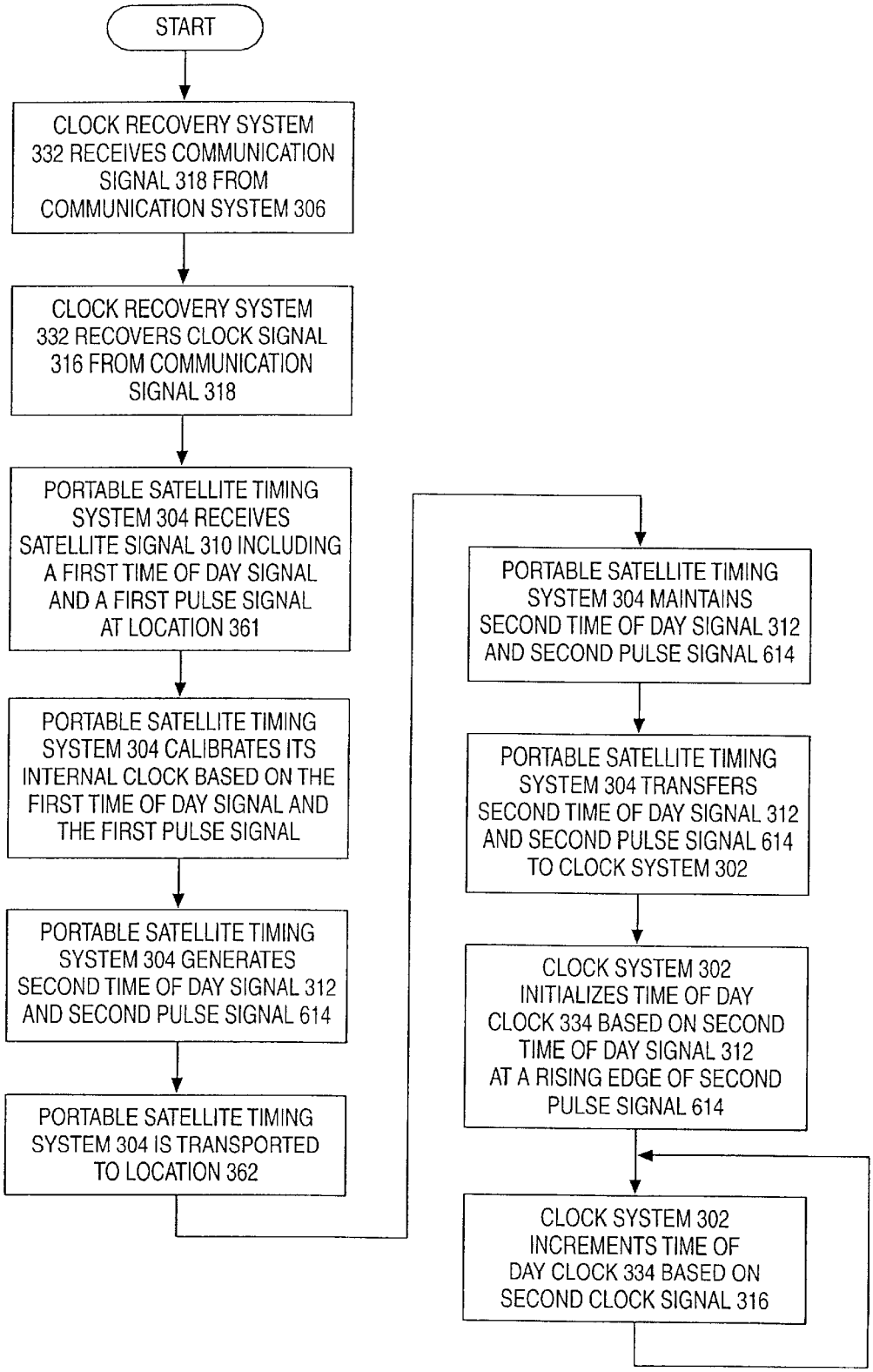
FIG. 8 is a flow chart that depicts a method of synchronizing a time of day clock of a clock system in an example of the invention.

Second Method and System of Synchronizing a Time of Day Clock—FIGS. 6–8

FIGS. 6–8 depict a specific example of a method and system for synchronizing time of day clock 334 of a clock system 302 in accord with the present invention. Those skilled in the art will appreciate numerous variations from this example that do not depart from the scope of the invention. Those skilled in the art will also appreciate that various features described below could be combined with other embodiments to form multiple variations of the invention. Those skilled in the art will appreciate that some conventional aspects of FIGS. 6–8 have been simplified or omitted for clarity.

FIG. 6 depicts clock system 302 positioned at location 362 where satellite signal 310 cannot be received on a reliable basis. Portable satellite timing system 304 is positioned at location 361 and de-coupled from clock system 302. Portable satellite timing system 304 is configured to receive satellite signal 310. Satellite signal 310 includes a first time of day signal and a first pulse signal. Portable satellite timing system 304 is comprised of antenna 622, power supply 620, satellite timing circuitry 624, and interface 626. Antenna 622 is coupled to satellite timing circuitry 624. Satellite timing circuitry 624 is coupled to interface 626. Communication system 306 is coupled to clock system 302 and is configured to transfer communication signal 318 to clock system 302. Communication system 306 could be at location 361, location 362, or some other location. Clock system 302 is comprised of a clock recovery system 332, time of day clock 334, and interface 630. Interface 630 is coupled to clock recovery system 332 and time of day clock 334. Clock recovery system 332 is coupled to time of day clock 334. Clock recovery system 332 is configured to recover clock signal 316 from communication signal 318. Clock signal 316 is about 10 MHz.

Portable satellite timing system 304 runs off of power from power supply 620. Power supply 620 could be a battery, a power line, an un-interruptable power supply, or some other power source. Portable satellite timing system 304 could be a portable Global Positioning System (GPS) or some other system that receives timing information from satellites.

FIG. 7 depicts portable satellite timing system 304 re-positioned at location 362 and coupled to clock system 302. Portable satellite timing system 304 does not receive satellite signal 310 at location 362 on a reliable basis. Satellite timing circuitry 624 is configured to generate second time of day signal 312 and second pulse signal 614 based on the first time of day signal and the first pulse signal, respectively. Interface 626 is configured to transfer second time of day signal 312 and second pulse signal 614 to interface 630. Second time of day signal 312 represents the current time of day. Second pulse signal 614 is a 1 Hz signal.

FIG. 8 depicts a method of synchronizing time of day clock 334. Interface 630 receives communication signal 318 from communication system 306. Communication system 306 is for example a Wide Area Network (WAN) that transfers communication signal 318 according to a WAN bit rate clock that is synchronized to the UTC. Interface 630 transfers communication signal 318 to clock recovery system 332. Clock recovery system 332 recovers clock signal 316 from communication signal 318. Clock recovery system 332 transfers clock signal 316 to time of day clock 334. In some embodiments, clock system 302 adjusts clock signal 316 to 10 MHz using a conventional Phase-Locked Loop (PLL).

Concurrently, antenna 622 receives satellite signal 310 when portable satellite timing system 304 is at location 361 as shown in FIG. 6. Antenna 622 transfers satellite signal 310 to satellite timing circuitry 624. Satellite timing circuitry 624 calibrates its internal clock based on the first time of day signal and the first pulse signal. Satellite timing circuitry 624 generates second time of day signal 312 and second pulse signal 614 based on its internal clock and transfers signals 312 and 614 to interface 626. Portable satellite timing system 304 is then transported to location 362 and coupled to clock system 302 as shown in FIG. 7. Because portable satellite timing system 304 does not receive satellite signal 310 at location 362, portable satellite timing system 304 maintains second time of day signal 312 and second pulse signal 614.

When coupled to clock system 302, interface 626 transfers second time of day signal 312 and second pulse signal 614 to interface 630. Interface 630 transfers second time of day signal 312 and second pulse signal 614 to time of day clock 334. Clock system 302 synchronizes time of day clock 334 based on second time of day signal 312, second pulse signal 614, and clock signal 316. To synchronize time of day clock 334, clock system 302 first initializes time of day clock 334 based on second time of day signal 312 on a rising edge of second pulse signal 614. After initializing time of day clock 334, clock system 302 increments time of day clock 334 based on clock signal 316 to keep track of time. Time of day clock 334 is now synchronized to Universal Time Coordinated (UTC) because second time of day signal 312, second pulse signal 614, and clock signal 316 are synchronized to the UTC. With clock signal 316 being the reference frequency for time of day clock 334, portable satellite timing system 304 can be de-coupled from clock system 302 after initialization. As long as clock recovery system 332 recovers clock signal 316 from communication signal 318, time of day clock 334 is synchronized to the UTC.

Those skilled in the art will appreciate variations of the above-described methods that fall within the scope of the invention. As a result, the invention is not limited to the specific examples and illustrations discussed above, but only by the following claims and their equivalents.

What is claimed is:

1. A method of synchronizing a time of day clock of a clock system, the method comprising:

receiving a communication signal from a communication system in the clock system and recovering a clock signal from the communication signal;

receiving a satellite signal including a first time of day signal with a portable satellite timing system at a first location and calibrating the portable satellite timing system based on the first time of day signal to generate a second time of day signal;

transporting the portable satellite timing system to a second location and coupling the portable satellite timing system to the clock system; and transferring the second time of day signal from the portable satellite timing system to the clock system and synchronizing the time of day clock based on the second time of day signal and the clock signal.

2. The method of claim 1 wherein the portable satellite timing system does not receive the satellite signal at the second location.

3. The method of claim 1 wherein the clock signal is about 10 MHz.

4. The method of claim 1 further comprising receiving the satellite signal including a first pulse signal with a portable satellite timing system at the first location and calibrating the portable satellite timing system based on the first pulse signal to generate a second pulse signal.

5. The method of claim 4 further comprising transferring the second pulse signal from the portable satellite timing system to the clock system and synchronizing the time of day clock based on the second pulse signal.

6. The method of claim 5 wherein the second pulse signal is about 1 Hz.

7. The method of claim 1 further comprising:

receiving the satellite signal including a first pulse signal with the portable satellite timing system at the first location and calibrating the portable satellite timing system based on the first pulse signal to generate a second pulse signal;

transporting the portable satellite timing system to the second location and coupling the portable satellite timing system to the clock system;

transferring the second pulse signal from the portable satellite timing system to the clock system;

initializing the time of day clock based on the second time of day signal at an edge of the second pulse signal; and incrementing the time of day clock based on the clock signal.

8. The method of claim 1 wherein the portable satellite timing system comprises a portable Global Positioning System.

9. The method of claim 1 wherein the portable satellite timing system has battery power.

10. The method of claim 1 wherein the portable satellite timing system has a satellite antenna.

11. The method of claim 1 wherein synchronizing the time of day clock further comprises synchronizing the time of day clock to Universal Time Coordinated.

12. The method of claim 1 wherein the communication system comprises a Wide Area Network.

* * * * *